US009713414B2

(12) United States Patent
Beshears, Jr. et al.

(10) Patent No.: US 9,713,414 B2
(45) Date of Patent: Jul. 25, 2017

(54) DISHWASHER HAVING A CONDUIT FRAMEWORK

(71) Applicant: Whirlpool Corporation, Benton Harbor, MI (US)

(72) Inventors: Paul E. Beshears, Jr., Stevensville, MI (US); John J. Burns, Saint Joseph, MI (US); Elliott V. Stowe, Stevensville, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 502 days.

(21) Appl. No.: 13/923,424

(22) Filed: Jun. 21, 2013

(65) Prior Publication Data

US 2014/0373885 A1 Dec. 25, 2014

(51) Int. Cl.
*A47L 15/42* (2006.01)

(52) U.S. Cl.
CPC ..... *A47L 15/4214* (2013.01); *A47L 15/4246* (2013.01); *A47L 15/4274* (2013.01)

(58) Field of Classification Search
CPC ... A47L 15/4274; F16K 3/184; F16K 31/524; F15K 31/52441
See application file for complete search history.

(56) References Cited

U.S. PATENT DOCUMENTS

| | | | | |
|---|---|---|---|---|
| 3,636,981 | A | 1/1972 | Henry | |
| 3,794,061 | A * | 2/1974 | Horvath | C02F 1/42 137/330 |
| 3,884,263 | A | 5/1975 | Wright | |
| 5,924,433 | A | 7/1999 | Thies et al. | |
| 7,270,132 | B2 | 9/2007 | Inui et al. | |
| 7,445,013 | B2 | 11/2008 | VanderRoest et al. | |
| 7,523,758 | B2 | 4/2009 | VanderRoest et al. | |
| 7,614,408 | B2 | 11/2009 | Park et al. | |
| 7,887,642 | B2 | 2/2011 | Jerg et al. | |
| 2008/0283099 | A1 * | 11/2008 | Peukert | A47L 15/4291 134/99.1 |
| 2010/0218793 | A1 * | 9/2010 | Olesen | A47L 15/4246 134/58 DL |
| 2012/0138106 | A1 * | 6/2012 | Fountain | A47L 15/0084 134/111 |
| 2012/0138107 | A1 | 6/2012 | Fountain et al. | |

FOREIGN PATENT DOCUMENTS

| | | | |
|---|---|---|---|
| DE | 3345603 | A1 | 6/1985 |
| DE | 3922755 | A1 | 1/1991 |
| DE | 102007013813 | A1 | 9/2008 |
| EP | 0786230 | A2 | 7/1997 |
| GB | 2151466 | A | 7/1985 |

OTHER PUBLICATIONS

German Search Report for Counterpart DE102014105830.5, dated Dec. 3, 2014.

* cited by examiner

*Primary Examiner* — Jason Ko
*Assistant Examiner* — Spencer Bell
(74) *Attorney, Agent, or Firm* — McGarry Bair PC

(57) ABSTRACT

A dishwasher has a tub at least partially defining a treating chamber for receiving dishes for treatment according to an automatic cycle of operation. At least one wall of the tub has spaced outer and inner panels and a conduit framework extending between the outer and inner panels to define a plurality of conduits. The conduits can convey liquid, air, and/or electrical wiring.

18 Claims, 9 Drawing Sheets

DISHWASHER HAVING A CONDUIT FRAMEWORK

BACKGROUND OF THE INVENTION

Contemporary automatic dishwashers for use in a typical household include a tub and at least one rack or basket for supporting soiled dishes within the tub. A spraying system may be provided for recirculating liquid throughout the tub to remove soils from the dishes. The spraying system can have one or more sprayers which are supplied with liquid by supply conduits. Wash liquid is recirculated through the treating chamber by a wash pump which fluidly couples the treating chamber to the supply conduits to recirculate liquid in the treating chamber.

A drying system may be provided for circulating air throughout the tub to dry the dishes. The drying system can have one or more vents which are supplied with air by supply conduits. Air is circulated through the treating chamber by a blower which fluidly couples the treating chamber to the supply conduits.

Operative devices, examples of which include user interfaces/control panels, displays, and lights, provided on the dishwasher can require a supply of power and/or data communication.

BRIEF DESCRIPTION OF THE INVENTION

The invention relates to a dishwasher for treating dishes according to an automatic cycle of operation. In one aspect of the invention, the dishwasher comprises a tub at least partially defining a treating chamber for receiving dishes for treatment and having a wall comprising spaced outer and inner panels and a conduit framework extending between the outer and inner panels to define a plurality of conduits, wherein the plurality of conduits can convey at least one of liquid, air, and electrical wiring.

In another aspect of the invention, the dishwasher comprises a tub at least partially defining a treating chamber for receiving dishes for treatment and having a wall comprising spaced outer and inner panels and a conduit framework extending between the outer and inner panels to define a plurality of conduits, wherein the plurality of conduits convey a fluid to or from the treating chamber and a manifold assembly having a plurality of outlets corresponding to the plurality of conduits.

DESCRIPTION OF EMBODIMENTS OF THE INVENTION

Figure 1:
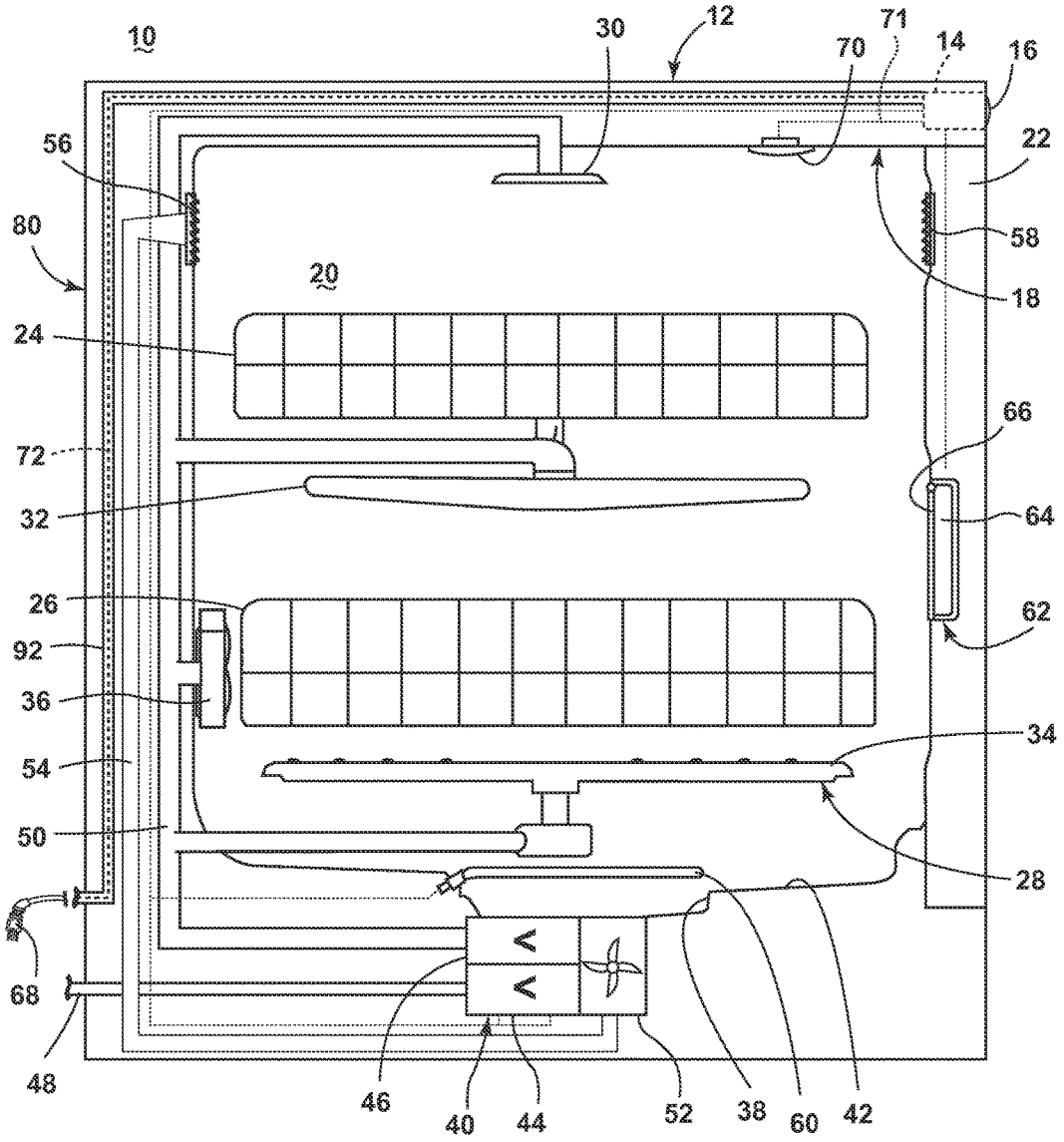
FIG. 1 is a schematic, side view of a dishwasher according to a first embodiment of the invention.

FIG. 1 is a schematic, side view of a dishwasher 10 according to a first embodiment of the invention. In FIG. 1, the dishwasher 10 includes a chassis 12 defining an interior. Depending on whether the dishwasher 10 is a stand-alone or built-in dishwasher, the chassis 12 may be a frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the chassis 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the interior of the chassis 12 and at least partially defines a treating chamber 20 with an access opening in the form of an open face. A cover, illustrated as a door 22, may be hingedly mounted to the chassis 12 and may move between an opened position, wherein the user may access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; dishes, plates, pots, bowls, pans, glassware, silverware, and other utensils. While not shown, additional dish holders, such as a silverware basket on the interior of the door 22 or a third level rack above the upper rack 24 may also be provided.

A spraying system 28 may be provided for spraying liquid into the treating chamber 20 and is illustrated in the form of an upper sprayer 30, a mid-level sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to or integral with the tub 18, adjacent to the lower rack 26, and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety. Instead of or in addition to the spray manifold 36 provided on the rear wall, nozzles can be provided on the right and left side walls of the tub 18.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46. The drain pump 44 may draw liquid from the sump 38 and pump the liquid out of the dishwasher 10 to a household drain line 48. The recirculation pump 46 may draw liquid from the sump 38, and the liquid may be simultaneously or selectively pumped through a liquid supply conduit 5 0 to each of the spray assemblies 30, 32, 34, 36 for selective spraying.

While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

An air supply system may be provided for circulating air through the treating chamber 20 to remove humid air from the treating chamber 20 and dry the dishes in the racks 24, 26. The air supply system can include a fan or blower 52 fluidly coupled with the ambient surroundings to intake air from the exterior of the dishwasher 10 and an air supply conduit 54 for circulating air through the treating chamber 20 via an inlet vent 56 formed in the tub 18.

Further, the air supply system may include an outlet fluidly open to ambient air. An example of such an outlet has been illustrated as an outlet vent 58, which may exhaust the supplied air from the treating chamber 20. The outlet vent 58 may be fluidly coupled to an outlet duct (not shown), which vents into the interior of the door 22, allowing air to escape through the various openings in the door 32. Alternatively the outlet vent 58 may be formed elsewhere in the dishwasher 10.

A heating system having a heating element 60 may be located within or near the sump 38 for heating liquid contained in the sump 38. The heating element 60 may also heat air contained in the treating chamber 20. Alternatively, a separate heating element (not shown) can be provided for heating the air circulated through the treating chamber 20 by the blower 52. A filtering system (not shown) may be fluidly coupled with the recirculation flow path for filtering the recirculated liquid.

A dispensing system may be provided for storing and dispensing treating chemistry to the treating chamber 20. As shown herein, the dispensing system can include a dispenser 62 mounted on an inside surface of the door 22 such that the dispenser 62 is disposed in the treating chamber 20 when the door 22 is in the closed position. The dispenser 62 is configured to dispense treating chemistry to the dishes within the treating chamber 20. The dispenser 62 can have one or more compartments 64 closed by a door 66 on the inner surface of the door 22. The dispenser 62 can be a single use dispenser which holds a single dose of treating chemistry, a bulk dispenser which holds a bulk supply of treating chemistry and which is adapted to dispense a dose of treating chemistry from the bulk supply during a cycle of operation, or a combination of both a single use and bulk dispenser. The dispenser 62 can further be configured to hold multiple different treating chemistries. For example, the dispenser 62 can have multiple compartments defining different chambers in which treating chemistries can be held. While shown as being disposed on the door 22, other locations of the dispenser 62 are possible.

The dishwasher 10 can include various electrical components, such as lights, sensors, switches, and other powered devices. The electrical components can be coupled with a suitable electrical supply, such as a conventional household electrical socket, via a power cord 68. In one example, an electrical component in the form of a light 70 is provided for illuminating the treating chamber 20, and can be coupled with the controller 14 via electrical wiring 71. The controller 14 is in turn coupled to the power cord 68 via electrical wiring 72.

Figure 2:
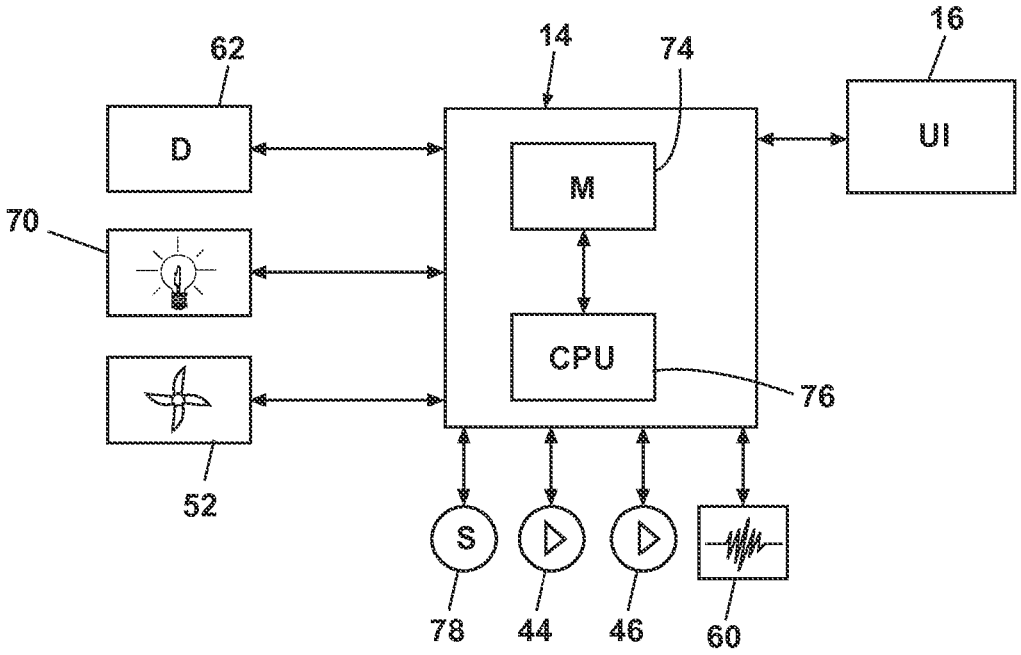
FIG. 2 is a schematic view of a controller of the dishwasher of FIG. 1.

FIG. 2 is a schematic view of the controller 14 of the dishwasher 10 of FIG. 1. As illustrated schematically in FIG. 2, the controller 14 may be coupled with the heater 60 for heating the wash liquid during a cycle of operation, the drain pump 44 for draining liquid from the treating chamber 20, the recirculation pump 46 for recirculating the wash liquid during the cycle of operation, the blower 52 for circulating air through the treating chamber 20, the dispenser 62 for selectively dispensing treating chemistry to the treating chamber 20, and the light 70 for illuminating the treating chamber 20. The controller 14 may be provided with a memory 74 and a central processing unit (CPU) 76. The memory 74 may be used for storing control software that may be executed by the CPU 76 in completing a cycle of operation using the dishwasher 10 and any additional software. For example, the memory 74 may store one or more pre-programmed cycles of operation that may be selected by a user and completed by the dishwasher 10. The controller 14 may also receive input from one or more sensors 78. Non-limiting examples of sensors 78 that may be communicably coupled with the controller 14 include a temperature sensor and turbidity sensor to determine the soil load associated with a selected grouping of dishes, such as the dishes associated with a particular area of the treating chamber 20.

Figure 3:
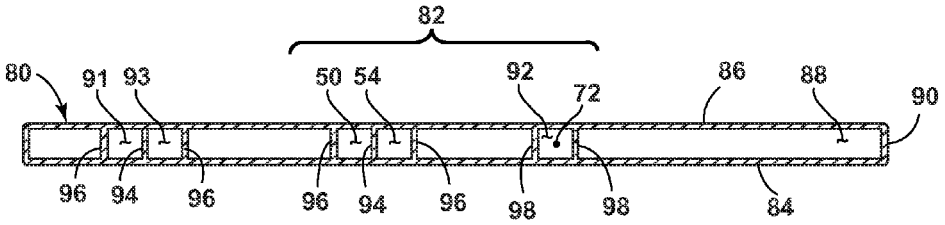
FIG. 3 is a sectional view of a rear wall of the dishwasher from FIG. 2.

FIG. 3 is a sectional view of a rear wall of the dishwasher from FIG. 2. The dishwasher 10 may further include at least one wall having a plurality of conduits for conveying liquid, air, and/or electrical wiring for the dishwasher 10. In the embodiment shown, the rear wall 80 of the tub 18 is provided a conduit framework 82 which defines the plurality of conduits for conveying liquid, air, and/or electrical wiring. The rear wall 80 can have an inner panel 84, which can form an interior surface of the treating chamber 20 (FIG. 1), and an outer panel 86 which is spaced from the inner panel 84 to define a gap 88 and joined by a periphery 90. The conduit framework 82 can extend through the gap 88 between the inner and outer panels 84, 86.

The inner and outer panels 84, 86 can be assembled into a substantially flat piece with nominal thickness which provides sufficient structural integrity to the conduit framework 82 and also allows the flat piece to double as the rear wall 80 of the tub 18. In particular, the surface of the inner panel 84 forming the interior surface of the treating chamber 20 can be substantially flat, which can reduce the accumulation of soil on the inner panel 84. However, a limited number of features can protrude from the inner panel, such as fittings for fluid conduits or vents, such as the fluid conduits supplying the spray assemblies 32, 34, 36, and the inlet vent 56 from FIG. 1.

The rear wall 80 can be joined to the other walls of the tub 18 with a water-tight joint to prevent water leakage. For example, a locking tongue and groove joint fitted with a gasket can be used. This type of joint also allows for easy of assembly of the rear wall 18 with the tub 18 during manufacturing.

While the rear wall 80 is shown herein as containing the conduit framework 82, other walls of the tub 18, such as the side walls, can also contain the conduit framework 82. Furthermore, the conduit framework 82 can extend through more than one wall of the tub 18.

Figure 4:
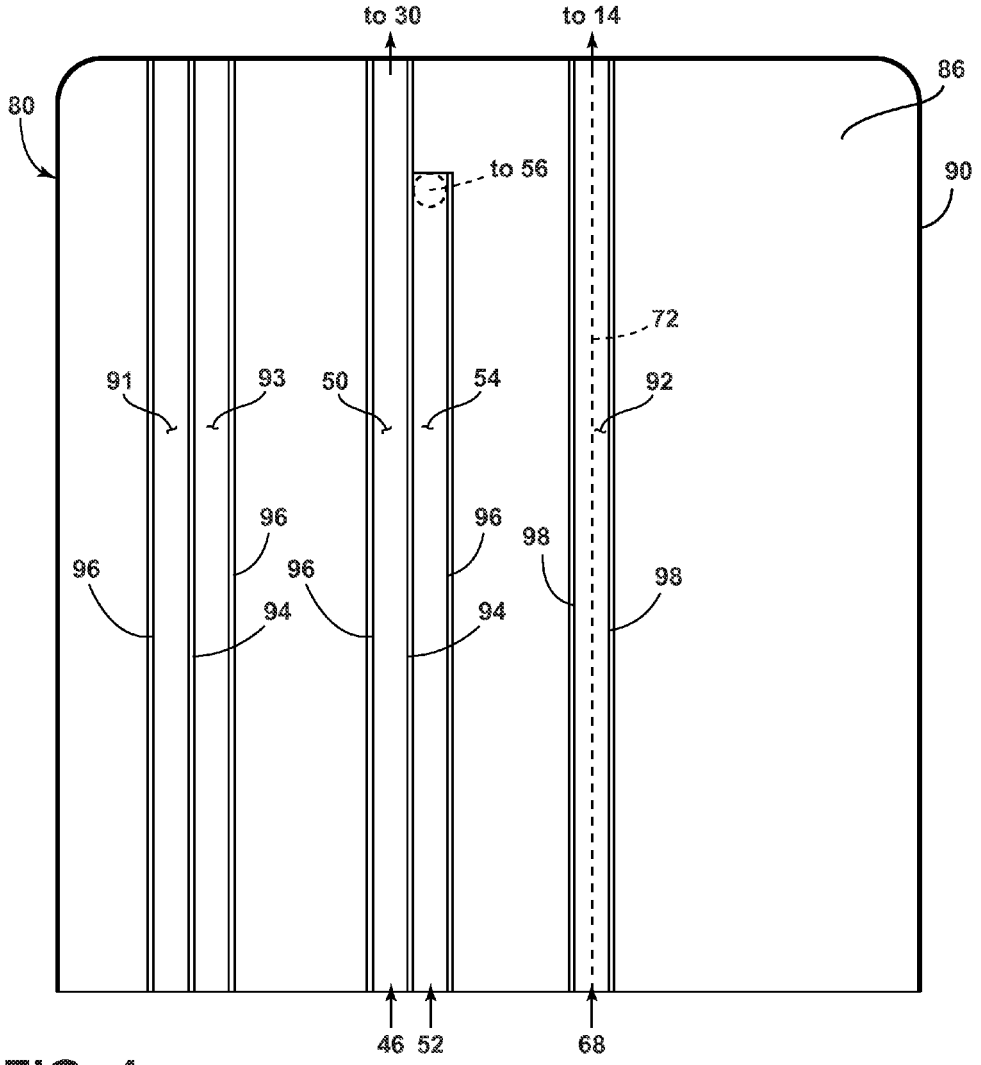
FIG. 4 is a front view of the rear wall of the dishwasher from FIG. 2, with an inner panel of the rear wall removed for clarity.

FIG. 4 is a front view of the rear wall 80 with the inner panel 84 removed for clarity. As shown herein, the conduit framework 82 defines a series of conduits arranged side-by-side which provide flow paths for liquid delivery, air delivery and/or electrical wiring both into and out of the dishwasher 10. In the example shown, the conduits include the liquid supply conduit 50 in fluid communication with the recirculation pump 46 and the sprayer 30 for conveying liquid from the recirculation pump 46 to the sprayer 30, the air supply conduit 54 in fluid communication with the blower 52 and the inlet vent 56, and an electrical conduit 92 which receives the electrical wiring 72 coupling the controller 14 with the power cord 68. Additional conduits (not shown) can also be provided as part of the conduit framework 82.

Optionally, the dishwasher 10 may further include a water softening system for reducing the hardness of water supplied to the treating chamber by reducing the concentration of calcium, magnesium, or other metal cations in the water, and a regeneration system for regenerating softening agents used by the water softening system. The water softening system can include a salt chamber (not shown) and a supply conduit 91 that connects the salt chamber to the regeneration system for supplying used softening agent to the regeneration system. The regeneration system can include a regeneration tank (not shown) and a return conduit 93 that connects the regeneration tank to the salt chamber for returning regenerated softening agent to the water softening system. The conduits 91, 93 can be part of the conduit framework 82.

The conduits 50, 54, 91, 92, 93 can be defined by one or more walls extending along the rear panel 86. Some walls can be common to more than one conduit; for example, the liquid supply conduit 50 and the air supply conduit 54 can be adjacent to one another, divided by a common wall 94. Outer walls 96 spaced on either side of the common wall 94 define the conduits 50, 54. A similar configuration can be used for the regeneration supply and return conduits 91, 93. The electrical conduit 92 is defined by spaced walls 98 which are not shared by other conduits.

Figure 5:
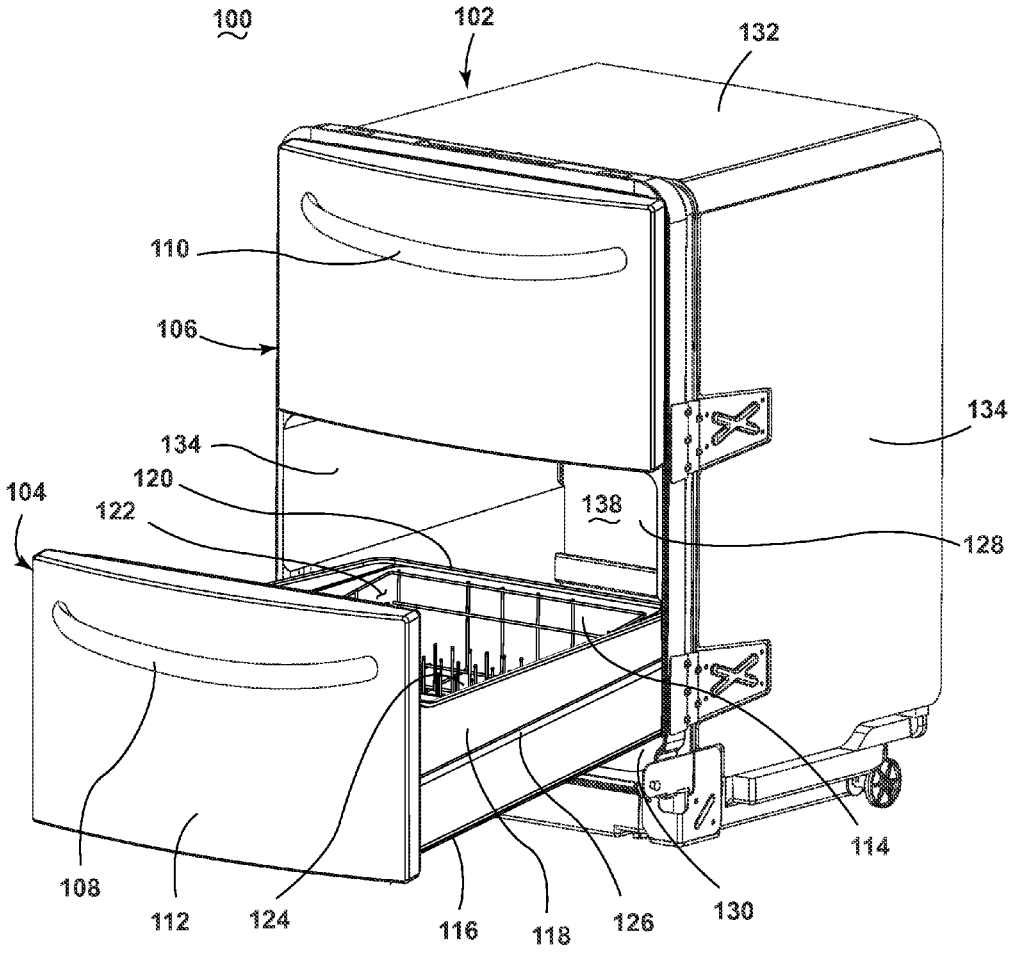
FIG. 5 is a perspective view of a multi-compartment dishwasher according to a second embodiment of the invention.

FIG. 5 is a perspective view of a multi-compartment dishwasher according to a second embodiment of the invention. The dishwasher 100 includes a chassis 102, which defines an interior. The chassis 102 may be a cabinet or a frame, with or without exterior panels. Built-in dishwashers typically have only a frame without panels, whereas stand-alone dishwashers have a frame with decorative panels covering the frame. A lower compartment 104 and an upper compartment 106 are illustrated as being included in the dishwasher 100. These lower and upper compartments 104, 106 are illustrated as being slide-out drawer units of similar size, each having a handle 108, 110, respectively, for facilitating movement of the drawer units between an open and closed position. However, one compartment 104, 106 may have a small or medium capacity so as to be used for washing smaller or more delicate utensils, such as glassware and the like, while the other compartment 104, 106 may be a larger capacity drawer for washing larger or more robust utensils, such as dinnerware, cookware and other large sized objects. Also, the dishwasher 100 could include a combination single pull-out drawer unit and a conventional dishwashing unit, with a hinged door.

Like the dishwasher 10 of the first embodiment, the dishwasher 100 can include a control system, spraying system, liquid recirculation system, air supply system, heating system, filtering system, and dispensing system as described above.

Lower compartment 104 is shown in the opened position in FIG. 5, and includes a front wall 112, a rear wall 114, a bottom wall 116 and opposing side walls 118 that collectively form a first or lower drawer 120. The lower drawer 120 is provided with a dish rack 124 for supporting various objects, such as utensils and the like, to be exposed to a treating operation. Lower compartment 104 may be slidably mounted to the chassis 102 through a pair of extendible support guides, one of which is indicated at 126. In this manner, the lower compartment 104 may carry the drawer 120 between the open and closed positions. While shown in the closed position in FIG. 5, the interior of the upper compartment 106 can be substantially similar to the lower compartment 104.

The chassis 102 includes an open front, a rear wall 128, a bottom wall 130, a top wall 132, and opposing side walls 134 that at least partially defines an interior 138 in which the compartments 104, 106 may be received. Portions of the chassis 102 along with the lower drawer 120 collectively form a tub that at least partially defines a first or lower treating chamber 122 of the lower compartment 104. In the illustrated embodiment, the lower treating chamber 122 can be defined by the front wall 112, rear wall 114, bottom wall 116 and opposing side walls 118 of the lower drawer 120 and the rear wall 128 and opposing side walls 134 of the chassis 102. For example, the "rear wall" of the treating chamber 122 of the lower compartment 104 can be collectively formed by rear walls 114 and 128.

The rear wall 128 can be joined to the other walls 130-134 of the chassis 102 with a water-tight joint to prevent water leakage. For example, a locking tongue and groove joint fitted with a gasket can be used. This type of joint also allows for easy of assembly of the rear wall 128 during manufacturing. At least one of the walls 128-134 of the chassis 102 can be provided with a conduit framework, similar to the conduit framework 82 described above.

Figure 6:
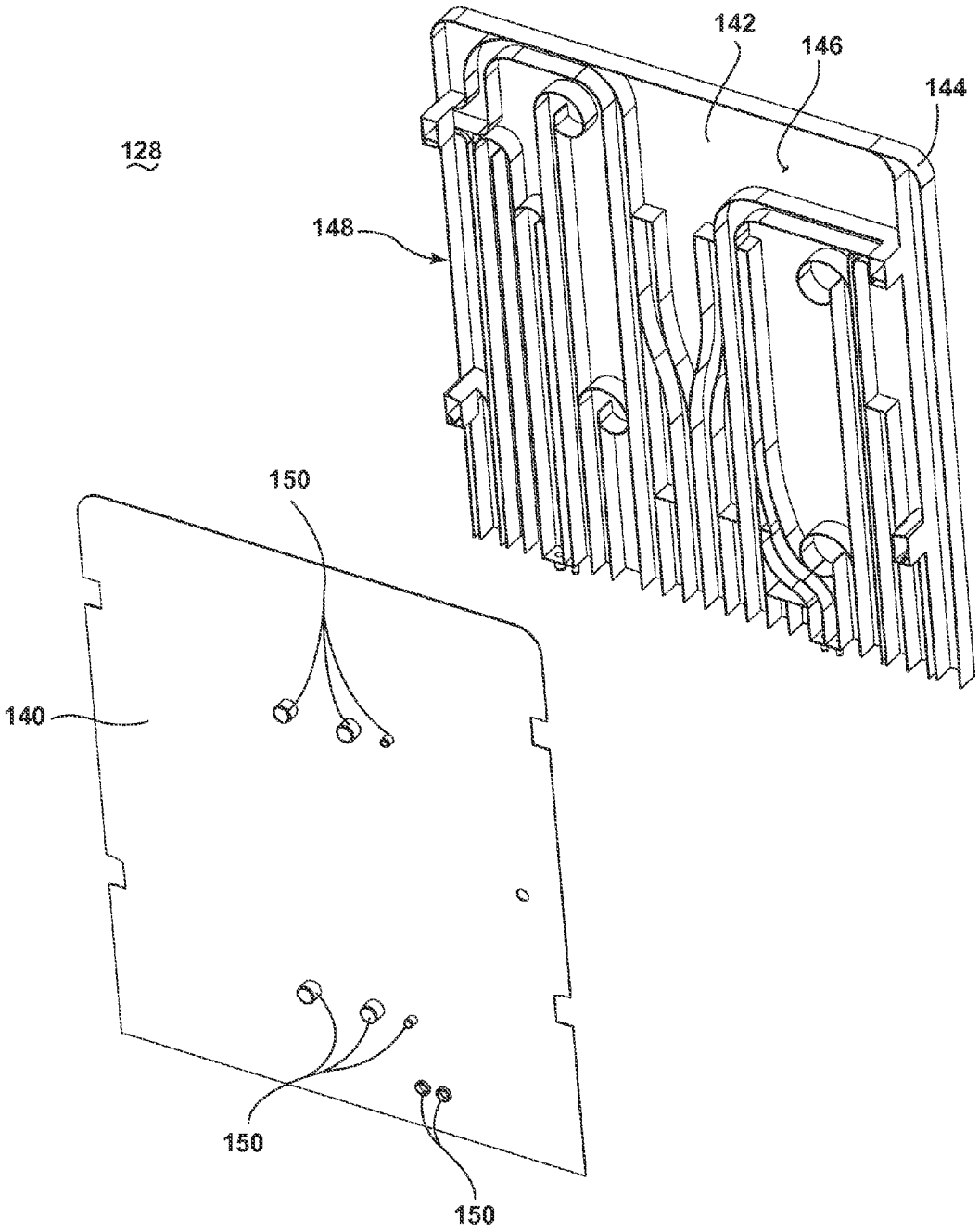
FIG. 6 is an exploded view of a rear wall of the dishwasher from FIG. 5.

FIG. 6 is an exploded view of the rear wall 128 of the chassis 102 of the dishwasher 100 from FIG. 5. The rear wall 128 can have an inner panel 140, which can form an interior surface of the interior 138, and an outer panel 142 which is spaced from the inner panel 140 and joined at a periphery 144 to define a gap 146. The rear wall 128 is provided a conduit framework 148 which defines the plurality of conduits for conveying liquid, air, and/or electrical wiring. The conduit framework 148 can extend between the inner and outer panels 140, 142 through the gap 146.

The inner and outer panels 140, 142 can be assembled into a substantially flat piece with nominal thickness which provides sufficient structural integrity to the conduit framework 148 and also allows the flat piece to double as the rear wall 128 of the chassis 102. In particular, the surface of the inner panel 140 can be substantially flat, which can reduce the accumulation of soil on the inner panel 140. However, a limited number of features can protrude from the inner panel, such as fittings 150 for fluid conduits, vents, or the like.

The conduit framework 148 defines a plurality of conduits, and can be in communication with various components of the dishwasher 100. For example, for conduits conveying liquid, the conduits may be in communication with a recirculation pump, a drain pump, a sprayer, a sump, a treating chemistry dispenser, and/or a heater. For conduits conveying air, the conduits may be in communication with a fan/blower, a vent in one of the compartments 104, 106, and/or a heater. For conduits conveying electrical wiring, the conduits may be in communication with a power cord, a light, a controller, a user interface, and/or a heater.

While the rear wall 128 is shown herein as containing the conduit framework 148, other walls of the chassis 102 or the drawer 120 can also contain the conduit framework 148. Furthermore, the conduit framework 148 can extend through more than one wall of the chassis 102 or drawer 120.

Figure 7:
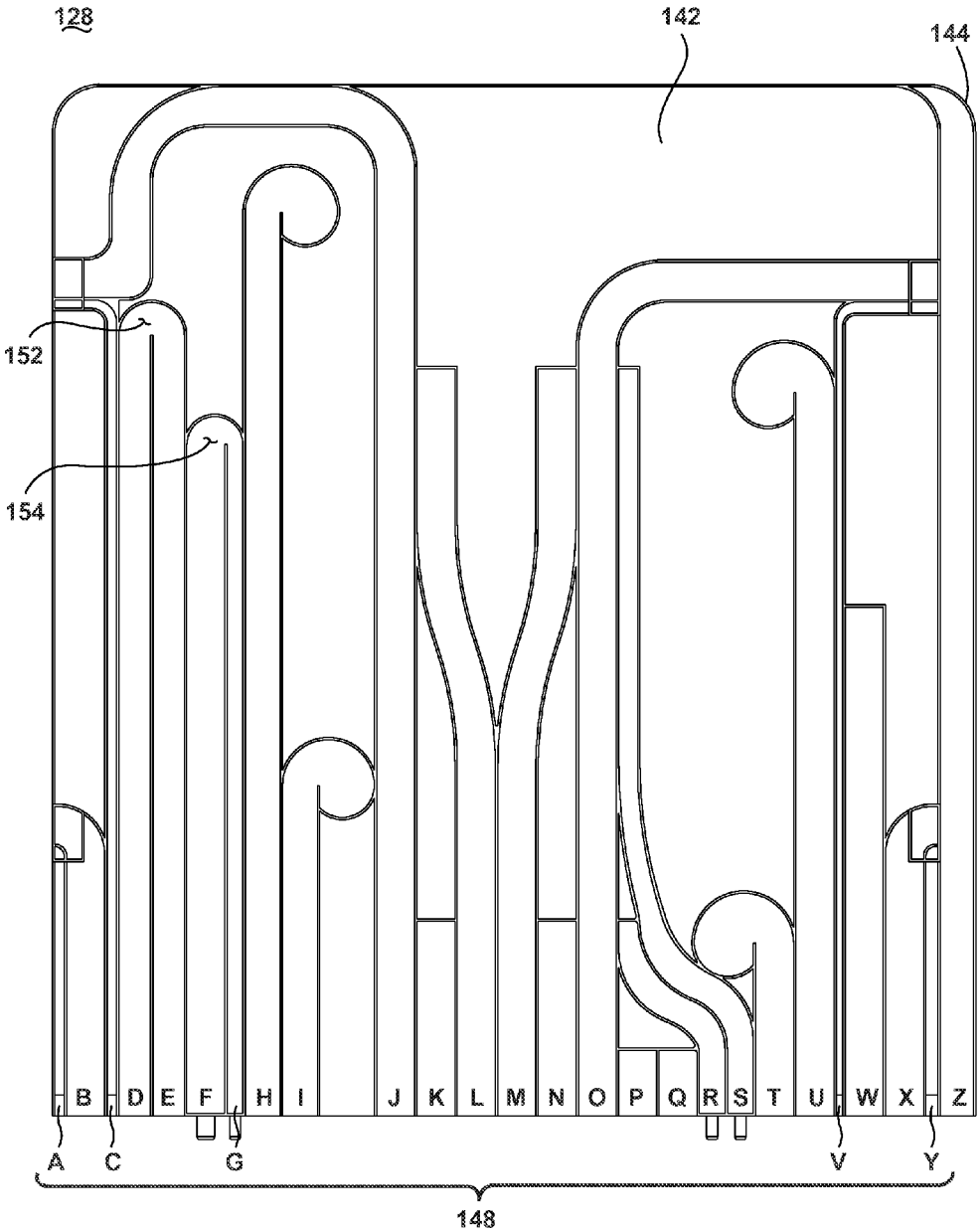
FIG. 7 is a front view of the rear wall of the dishwasher from FIG. 5, with an inner panel of the rear wall removed for clarity to illustrate a conduit framework.

FIG. 7 is a front view of the rear wall 128 with the inner 140 removed for clarity. The number and purpose of the conduits can vary; in the example shown herein, from left to right, the conduits convey the following:

| | | |
|---|---|---|
| A | Electrical | Light in lower compartment 104 |
| B | Liquid | To sprayer in lower compartment 104 |
| C | Electrical | Light in upper compartment 106 |
| D | Liquid | From drain siphon break to household drain line |
| E | Liquid | From drain pump to drain siphon break |
| F | Liquid | From recirculation siphon break to water supply hose |
| G | Liquid | From household water supply to recirculation siphon break |
| H | Air | From outlet for exhausting air from upper compartment 106 |
| I | Air | From outlet for exhausting air from lower compartment 104 |
| J | Liquid | To sprayer in upper compartment 106 |
| K | Liquid | To sprayer in lower compartment 104 |
| L | Liquid | To sprayer in upper compartment 106 |
| M | Liquid | To sprayer in upper compartment 106 |
| N | Liquid | To sprayer in lower compartment 104 |
| O | Liquid | To sprayer in upper compartment 106 |
| P | Liquid | To conduit B |
| Q | Liquid | To conduit X |
| R | Liquid | Liquid to flush dispenser in lower compartment 104 |
| S | Liquid | Liquid to flush dispenser in upper compartment 106 |
| T | Air | To inlet for drying air in upper compartment 106 |
| U | Air | To inlet for drying air in lower compartment 104 |
| V | Electrical | Light in upper compartment 106 |
| W | Liquid | From sump in upper compartment 106 |
| X | Liquid | To sprayers in lower compartment 104 |

-continued

| | | |
|---|---|---|
| Y | Electrical | Light in lower compartment 104 |
| Z | Liquid | From sump in lower compartment 104 |

Some of the conduits are connected to each other to form air gaps or siphon breaks. As illustrated, conduits D and E are coupled together to form a first siphon break 152 for preventing a siphon effect in the drain pathway, and conduits F and G are coupled together to form a second siphon break 154 for preventing a siphon effect in the recirculation pathway.

Figure 8:
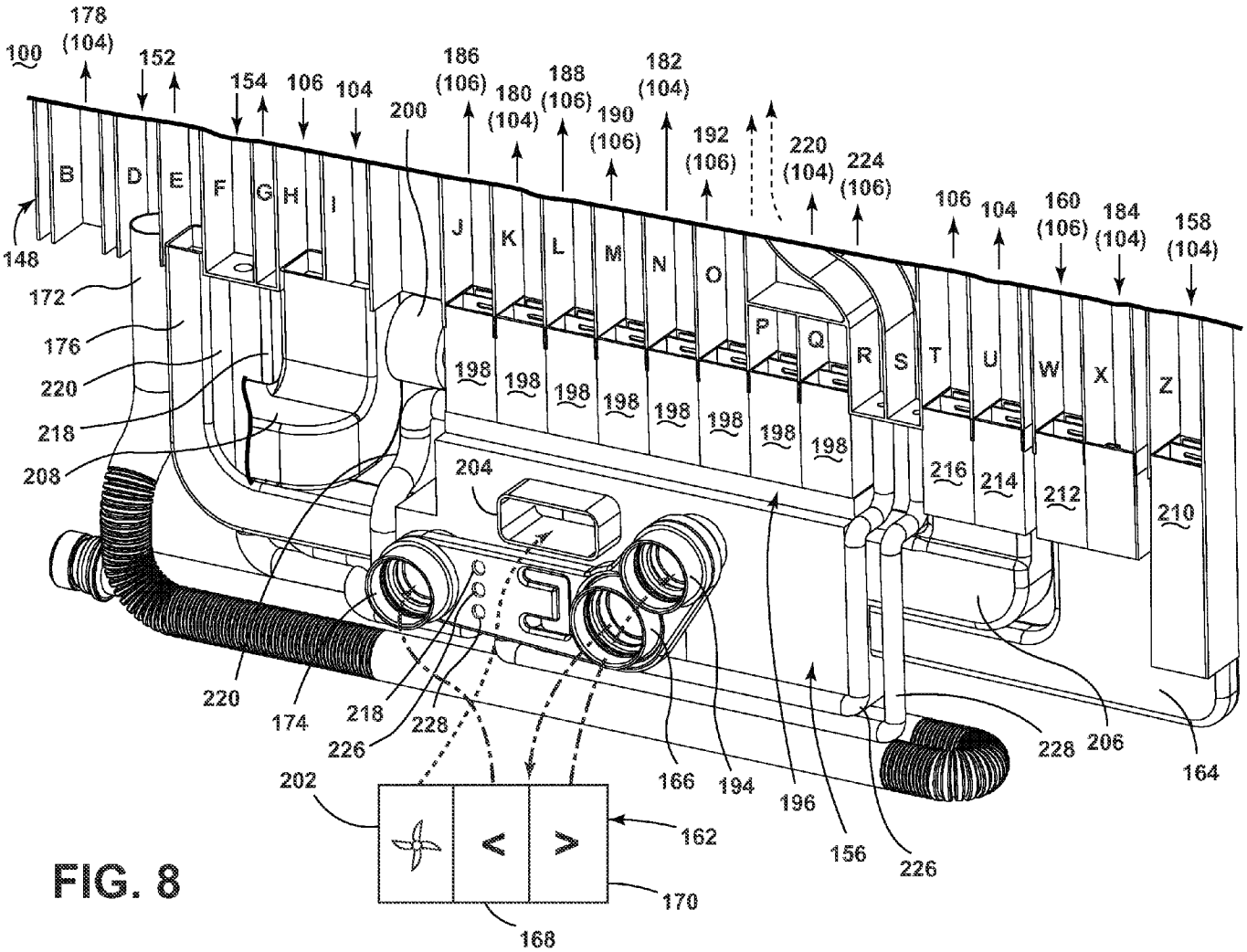
FIG. 8 is a partially schematic view of the conduit framework from FIG. 1 and its associated fluid connections.

FIG. 8 is a partially schematic view of the conduit framework 148 and its associated fluid connections. The dishwasher 100 can be provided with a manifold assembly 156 having a plurality of ports corresponding to at least some of the conduits of the conduit framework 148. The ports may act as inlets or outlets for the conduits. The manifold assembly 156 can route fluid, including air and/or liquid between various components of the liquid recirculation system and air supply system of the dishwasher 100, portions of which can be shared between the two compartments 104, 106.

The liquid recirculation system may include a sump 158, 160 in each of the compartments 104, 106, respectively and a common pump assembly 162. The sumps 158, 160 collect the liquid sprayed in the treating chambers of the compartments 104, 106 and are in fluid communication with conduits Z, W, respectively. The manifold assembly 156 includes a branched sump return adapter 164 that fluidly connects both conduits Z, W to a pump return coupling 166 leading to the pump assembly 162.

The pump assembly 162 may include both a drain pump 168 and a recirculation pump 170. The drain pump 168 may draw liquid from the sumps 158, 160 through the pump return coupling 166 and pump the liquid back out of the dishwasher 100 to a household drain line 172. The manifold assembly 156 can include a drain coupling 174 for receiving liquid from the drain pump 168 and directing the liquid to a drain adapter 176 fluidly connected to conduit E. Conduit E is fluidly coupled to conduit D to form the first siphon break 152 and conduit D is fluidly coupled to the household drain line 172.

The recirculation pump 170 may draw liquid from the sumps 158, 160 through the pump return coupling 166, and the liquid may be simultaneously or selectively pumped through one or more of the liquid supply conduits B, J-O, and X for selective spraying in the compartments 104, 106. Each compartment 104, 106 can have multiple sprayers. As shown herein, the lower compartment 104 has four sprayers 178, 180, 182, 184, each of which is supplied with liquid by a single conduit B, K, N, X, respectively. Likewise, the upper compartment 106 has four sprayers 186, 188, 190, 192, each of which is supplied with liquid by a single conduit, J, L, M, O, respectively.

The manifold assembly 156 can include a recirculation coupling 194 for receiving liquid from the recirculation pump 170 and directing the liquid to a valve assembly 196. The valve assembly 196 can be associated with at least some of the conduits of the conduit framework 148, such that one valve can be provided per conduit or per a subset of conduits, or a single conduit can be provided with multiple valves. As shown herein, a valve 198 can be associated with each of the plurality of liquid supply conduits J-Q for controlling the flow of fluid to the plurality of liquid supply conduits J-Q. The valves 198 are configured to move from a closed position, in which fluid does not pass through the associated ports or outlets in the manifold assembly 156, to an open position, in which fluid may pass through the outlets to enter the associated conduit J-Q. The valves 198 on conduits J-O directly control the flow of fluid to sprayers in the compartments 104, 106, while the valves 198 on conduits P, Q indirectly control the flow of fluid to sprayers by controlling the flow of fluid to conduits B, X, respectively. Conduits P, Q can be fluidly coupled to conduits B, X by pipes (not shown).

The valves 198 can be individually controllable, such that fluid flow through one of the conduits J-Q or a subset of the conduits J-Q can be individually controlled. The valves 198 can be coupled to a controller of the dishwasher 100, such as the controller 14 of FIG. 2.

The valve assembly 196 can be controlled to supply fluid to different sprayers 178-192 in various combinations for delivery to different areas of the dishwasher 100. One or more valve actuator(s) 200 can be operably coupled to the valves 198 for controlling the opening and closing of the valves 198. As shown herein, the valves 198 can share a common valve actuator 200 such that the one actuator can selectively control each valve 198. The valve actuator 200 can be coupled to a controller of the dishwasher 100, such as the controller 14 of FIG. 2.

Since the valves 198 supply different sprayers 178-192, the amount of wash liquid directed to different zones of the compartments 104, 106 can be easily controlled. For example, by supplying wash liquid to all conduits J, L, M, O leading the upper compartment 106, the spray coverage within the upper compartment 106 can be maximized. This can also provide a more gentle cleaning action, such as for china and/or stemware. However, by supplying water to only one of the conduits J, L, M, O leading to the upper compartment 106, a smaller zone within the upper compartment 106 can be targeted, and a greater concentration or spray pressure can be applied to the smaller zone for a more intense cleaning action. Any combination of the conduits J-Q can be supplied with wash liquid to achieve different wash performances. This can be controlled by the controller 14 (FIG. 2) to implement a selected cycle of operation.

The air supply system can include a fan or blower 202 fluidly coupled with the ambient surroundings to intake air from the exterior of the dishwasher 100, and the manifold assembly 156 can include an air supply coupling 204 for receiving air from the blower 202 and directing the air to a branched air inlet adapter 206 fluidly connected to both air conduits T, U. Further, the air supply system includes air conduits H, I which may exhaust the supplied air from the compartments 104, 106 and which lead to a common exhaust duct 208 in fluid communication with ambient air.

Additional valves can be provided for controlling the flow of fluid to other conduits. As shown, a valve 210 can be provided at conduit Z for controlling the flow of liquid from the sump 158 in the lower compartment 104 to the sump return adapter 164, while a valve 212 can be provided at conduit W for controlling the flow of liquid from the sump 160 in the upper compartment 106 to the sump return adapter 164. A valve 214 can be provided at conduit U for controlling the flow of air from the air inlet adapter 206 to the lower compartment 104, while a valve 216 can be provided at conduit T for controlling the flow of air from the air inlet adapter 206 to the upper compartment 106. The valves 210-216 can share the valve actuator 200 with the other liquid supply valves 198, or the valves 210-216 can each have a separate valve actuator (not shown) such that one actuator can selectively control one valve 210-216. Alternatively, the subsets of valves, such as valves 210 and 212, and valves 214, 216, can each be provided with a single actuator.

The liquid supply system further includes a water supply hose 218 coupled with a household water supply (not shown) for supplying water to the dishwasher 100. The water supply hose 218 is fluidly connected to conduit G. Conduit G is fluidly coupled to conduit F to form the second siphon break 154 and conduit F is fluidly coupled to a water return line 220. The water return line 220 joins the manifold assembly 156, and water is directed to the pump assembly 162 via the pump return coupling 166.

A dispensing system may be provided for storing and dispensing treating chemistry to the treating chambers in the compartments 104, 106, and can include flush-type dispensers 222, 224 provided in each compartment 104, 106, respectively. Water hoses 226, 228 coupled with the household water supply can extend from the manifold assembly 156 to the conduits R, S to supply water for flushing the dispensers 222, 224, respectively.

Figure 10:
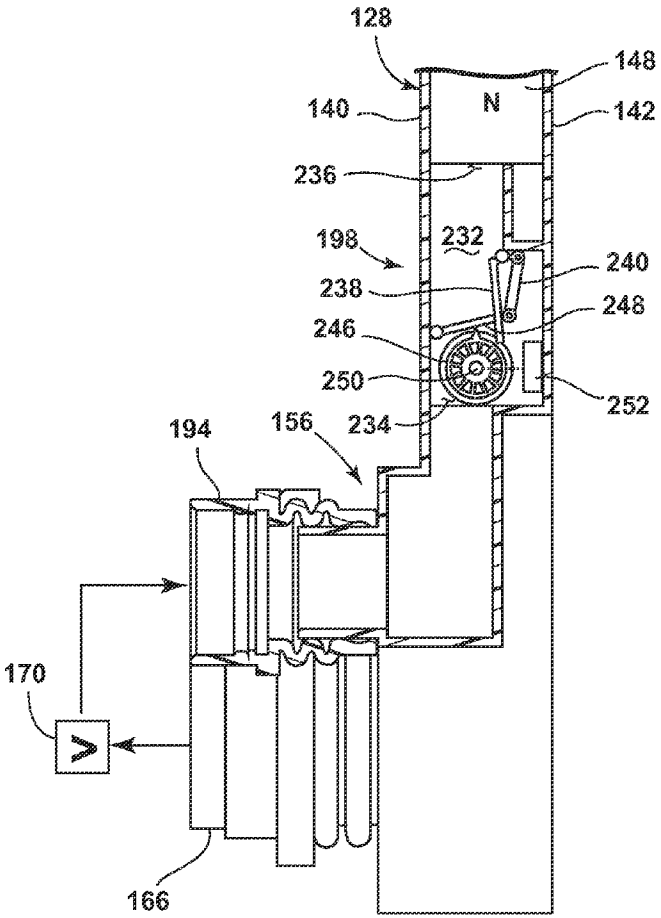
FIG. 10 is a view similar to FIG. 9, with the valve illustrated in an open position.
Figure 9:
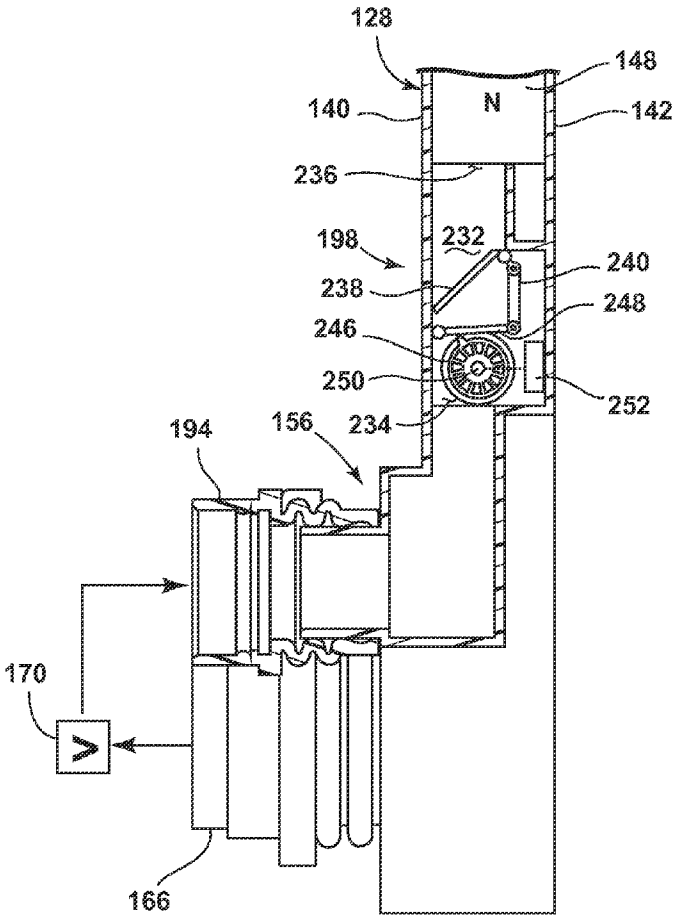
FIG. 9 is a schematic sectional view of a valve which can be used to control the flow of fluids through the conduit framework of FIG. 8, with the valve illustrated in a closed position.

FIGS. 9 and 10 are schematic sectional views of one of the valves 198 from FIG. 8. In each figure, only a portion of the manifold assembly 156 and the conduit framework 148, specifically conduit N, is shown, but it is understood that structure described for the valve 198 can be used for of any of the valves 198, 210, 212,214, 216 shown in FIG. 8.

The valves 198 comprise flipper valves having a valve chamber 232 with an inlet port 234 which is in fluid communication with the recirculation coupling 194 of the manifold assembly 156, and an outlet port 236, which is in fluid communication with conduit N of the conduit framework 148. The valve 198 further includes a door or flipper 238 pivotally mounted on one end of a valve linkage 240 which moves the flipper 238 between a closed position shown in FIG. 9 in which the flipper 238 closes the inlet port 234 and an opened position shown in FIG. 10 in which the flipper 238 opens the inlet port 234. When the flipper 238 is closed and no fluid flows through the valve chamber 232.

The valve actuator 200 can comprise a cam 246 having an associated cam follower 248 coupled with the valve linkage 240. The valve 198 is configured to move from the closed position to the opened position when the associated cam 246 bears against the cam follower 248. The valve actuator 200 can have a shaft 250 which carries the cam 246, and a motor 252 operably coupled to the shaft 250 for selective rotation of the shaft 250, which in turn rotates the cam 246. Examples of a suitable motor 252 are a motor with a position feedback sensor, a solenoid motor, or a wax motor. A cam 246 for each valve 198 shown in FIG. 8 can be provided on the shaft 250, and the cams 246 can be timed on the shaft 250 such that different valves 198 are open at different rotational angles of the shaft 250 corresponding to various points during a cycle of operation. The motor 252 can be coupled to a controller of the dishwasher 100, such as the controller 14 of FIG. 2.

Figure 11:
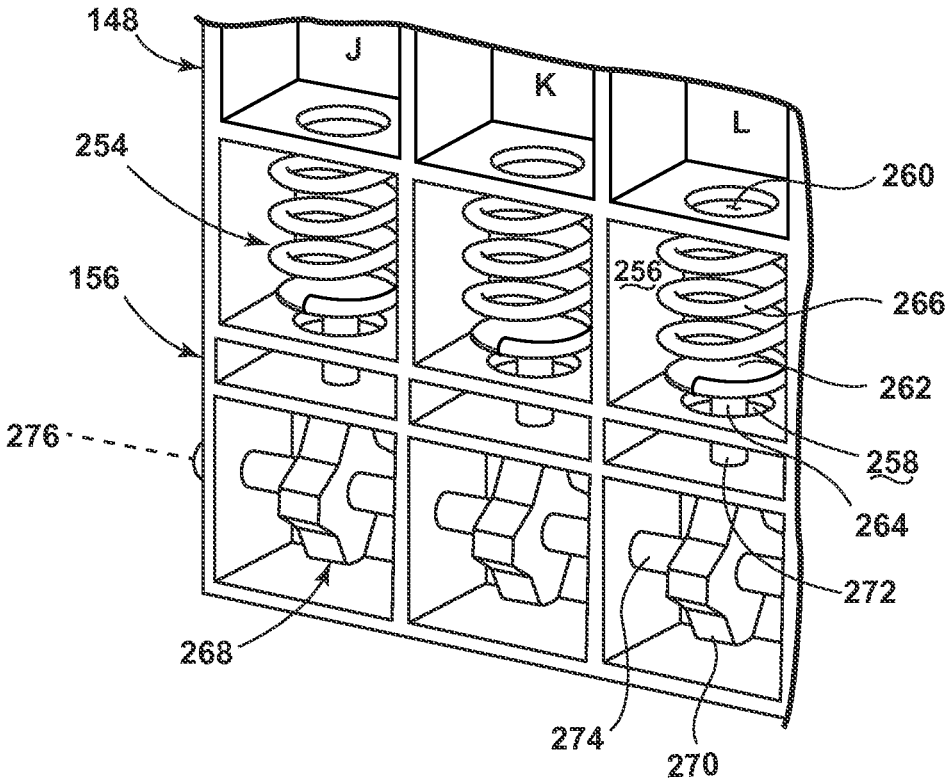
FIG. 11 is another example of a valve assembly which can be used to control the flow of fluids through the conduit framework of FIG. 8.

FIG. 11 shows another example of a valve assembly which can be used to control the flow of fluids through the conduit framework 148 of the second embodiment. In FIG. 11, only a portion of the manifold assembly 156 and the conduit framework 148, specifically conduits J-K, are shown, but it is understood that the valves can be used in place of any of the valves 198, 210, 212,214, 216 shown in FIG. 8.

In FIG. 11, the valve assembly comprises multiple pop-up valves 254 having a valve chamber 256 with an inlet port 258 which is in fluid communication with the recirculation coupling 194 of the manifold assembly 156 (FIG. 8), and an outlet port 260, which is in fluid communication with one of the conduits J-L of the conduit framework 148. Each valve 254 further includes a plug 262 on one end of a valve stem 264. The valve stem 264 guides the plug 262 between closed and open positions by sliding through the inlet port 258. When the plug 262 is seated against the inlet port 258, the valve 254 is closed and no fluid flows through the valve chamber 256. A spring 266 is received within the valve chamber 256 and biases the plug 262 to the closed position.

As shown herein, the valves 254 share a common valve actuator 268 such that one actuator can selectively control each valve 254. The valve actuator 268 can comprise a plurality of cams 270, each having an associated cam follower 272 coupled with the valve stem 264. The valves 254 are configured to move from the closed position to the open position when the associated cam 270 bears against the cam follower 272. The valve actuator 268 can have a common shaft 274 which carries the cams 270, and a motor 276 operably coupled to the shaft 274 for selective rotation of the shaft 274, which in turn rotates the cams 270. Examples of a suitable motor 276 are a motor with a position feedback sensor, a solenoid motor, or a wax motor. The cams 270 can be timed on the shaft 274, such that different valves 254 are open at different rotational angles of the shaft 274 corresponding to various points during a cycle of operation. The motor 276 can be coupled to a controller of the dishwasher 100, such as the controller 14 of FIG. 2.

The dishwasher disclosed herein provides an improved apparatus for routing fluids and electrical wiring through the dishwasher. One advantage that may be realized in the practice of some embodiments of the described dishwasher is that liquid, air, and electrical wiring can be easily routed to desired locations within the dishwasher. All the various routing conduits used in the dishwasher can be incorporated into a single flat piece that also serves the structural function of being a wall of the tub.

Another advantage that may be realized in the practice of some embodiments of the described dishwasher is that zonal delivery of liquid is easily controlled. Current dishwashers distribute liquid to specific sprayers located inside the dishwasher to accomplish specialized zonal cleaning operations, like silverware or pot cleaning. The zonal cleaning is limited by the fact that they only target small areas and requires the addition of a dedicated sprayer to an existing spraying system. The user must accurately place the dishes in the proper zone for the zonal cleaning feature to perform properly.

The present invention allows increased ability to offer zonal features to the user by dividing the liquid supply path into multiple conduits. Through valved control of the liquid flow, pressure can be increased or decreased, directed to any small target areas or distributed over larger zones. This allows for flexible water delivery to the entire wash chamber, effectively creating zonal features out of every area of the treating chamber, which can be customized to the user's needs.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, comprising:

a tub at least partially defining a treating chamber for receiving dishes for treatment, and having a tub wall, the tub wall comprising:

spaced outer and inner panels, the inner panel defining an interior surface of the treating chamber; and a conduit framework with a plurality of walls extending between the outer and inner panels of the tub wall to define a plurality of conduits arranged side-by-side such that a single wall of the plurality of walls has a first surface and a second surface, opposite the first surface, and where the first surface forms a wall of a first conduit of the plurality of conduits and the second surface forms a wall of a second conduit of the plurality of conduits, and terminating at a lower end of the tub wall, with the outer and inner panels forming the plurality of conduits with the conduit framework, the plurality of conduits comprising:

multiple liquid conduits to fluidly convey liquid from a source of liquid to separate locations in the treating chamber, the multiple liquid conduits including a first liquid conduit in fluid communication with a recirculation pump and a first sprayer for conveying liquid from the recirculation pump to the first sprayer and including a second liquid conduit in fluid communication with the recirculation pump and a second sprayer for conveying liquid from the recirculation pump to the second sprayer; and at least one of an air conduit in fluid communication with a source of air or an electrical conduit conveying electrical wiring and where the at least one of an air conduit or the electrical conduit is separate from liquid conduits within the dishwasher;

wherein the plurality of conduits can convey liquid and convey at least one of circulated air or electrical wiring in a space between the outer and inner panels of the tub wall, and wherein fluid vertically enters the plurality of conduits at the lower end of the tub wall and perpendicularly exits the plurality of conduits via fittings coupled to the inner panel.

2. The dishwasher of claim 1, wherein the interior surface is substantially flat.

3. The dishwasher of claim 1, wherein the plurality of conduits comprises at least one air conduit in fluid communication with a source of air and at least one electrical conduit conveying electrical wiring both of which are separate from liquid conduits within the dishwasher.

4. The dishwasher of claim 1, further comprising a sump and a drain pump, wherein at least one of the multiple liquid conduits is fluidly coupled between the sump and the drain pump such that the at least one liquid conduit receives liquid from the sump and conveys the liquid to the drain pump.

5. The dishwasher of claim 1 and further comprising a blower and an air vent, wherein at least one of the plurality of conduits comprises an air conduit in fluid communication between the blower and the air vent.

6. The dishwasher of claim 1 and further comprising a light located within the tub coupled to electric wiring and wherein at least one of the plurality of conduits conveys the electrical wiring to the light.

7. The dishwasher of claim 1 and further comprising a plurality of valves associated with the plurality of conduits for controlling the flow of fluid to the plurality of conduits.

8. The dishwasher of claim 1 and further comprising at least one component selected from a group consisting of:

a recirculation pump, a sprayer, a sump, a drain pump, a fan, and an air vent;

wherein at least one of the plurality of conduits is in fluid communication with the at least one component.

9. The dishwasher of claim 1 wherein at least two of the multiple liquid conduits extending between the outer and inner panels are connected to each other to form a siphon break.

10. A dishwasher for treating dishes according to an automatic cycle of operation, comprising:

a tub at least partially defining a treating chamber for receiving dishes for treatment, and having a tub wall, the tub wall comprising:

spaced outer and inner panels, the inner panel defining an interior surface of the treating chamber; and a conduit wall framework with a plurality of walls extending between the outer and inner panels to define a plurality of conduits arranged side-by-side, wherein a single wall of the plurality of walls has a first surface and a second surface, opposite the first surface, and where the first surface forms a wall of a first conduit of the plurality of conduits and the second surface forms a wall of a second conduit of the plurality of conduits with the outer and inner panels forming portions of the conduits along with the conduit wall framework, and wherein the plurality of conduits form flow paths to convey a fluid to or from the treating chamber and the plurality of conduits terminate at a lower end of the tub wall and where the plurality of conduits include multiple liquid conduits to fluidly convey liquid from a source of liquid to separate locations in the treating chamber, the multiple liquid conduits including a first liquid conduit in fluid communication with a recirculation pump and a first sprayer for conveying liquid from the recirculation pump to the first sprayer and including a second liquid conduit in fluid communication with the recirculation pump and a second sprayer for conveying liquid from the recirculation pump to the second sprayer; and a manifold assembly provided at the lower end of the tub wall and having a plurality of ports that extend upwards to couple to the corresponding plurality of conduits, which terminate at the lower end of the tub wall, wherein the plurality of ports of the manifold assembly are located in a space between the outer and inner panels of the tub wall and comprise inlets or outlets for the plurality of conduits, and wherein fluid vertically enters the plurality of conduits at the lower end of the tub wall and perpendicularly exits the plurality of conduits via fittings coupled to the inner panel.

11. The dishwasher of claim 10 and further comprising valves within the manifold assembly and associated with the plurality of ports for controlling the flow of fluid through the plurality of conduits.

12. The dishwasher of claim 11, wherein at least some of the valves comprise one of pop-up valves and flipper valves.

13. The dishwasher of claim 11, wherein at least some of the valves are individually-controllable such that varying combinations of flow paths can be opened.

14. The dishwasher of claim 11 and further comprising at least one valve actuator operably coupled to the valves.

15. The dishwasher of claim 14, wherein each valve comprises a cam follower and the at least one valve actuator comprises a cam associated with each cam follower, wherein each valve is configured to move to an open position when the associated cam bears against the cam follower.

16. The dishwasher of claim 15, wherein the at least one valve actuator comprises a common shaft carrying the cams associated with the valves and a motor operably coupled to the common shaft.

17. The dishwasher of claim 10 wherein the treating chamber houses a plurality of sprayers, each of which is supplied with liquid by a separate conduit of the plurality of conduits and where the manifold assembly includes a valve assembly configured to supply fluid to the plurality of sprayers in various combinations for delivery to different areas of the dishwasher.

18. The dishwasher of claim 10 wherein the manifold assembly further comprises a branched adapter that fluidly combines liquid conveyed through at least two of the plurality of ports before the liquid is conveyed to a pump assembly.

* * * * *